United States Patent [19]

van der Werff

[11] 3,946,686

[45] Mar. 30, 1976

[54] BOTTOM-DUMP VESSEL

[75] Inventor: Bartele van der Werff, Medemblik, Netherlands

[73] Assignee: A. Vuyk & Zonen's Scheepswerven B.V., Capelle an der Ijssel, Netherlands

[22] Filed: Mar. 28, 1974

[21] Appl. No.: 455,733

[30] Foreign Application Priority Data

Mar. 30, 1973 Netherlands ..... 7304466

[52] U.S. Cl. ..... 114/29

[51] Int. Cl.[2] ..... B63B 35/30

[58] Field of Search ..... 114/27, 29, 36, 35; 105/240, 290, 304, 262, 263; 214/656, 657

[56] References Cited

UNITED STATES PATENTS

| | | | |
|---|---|---|---|
| 1,493,675 | 5/1924 | Immand | 105/290 |
| 3,509,841 | 5/1970 | DeBoer | 114/29 |

FOREIGN PATENTS OR APPLICATIONS

| | | | |
|---|---|---|---|
| 1,292,532 | 4/1969 | Germany | 114/29 |

*Primary Examiner*—Trygve M. Blix
*Assistant Examiner*—Gregory W. O'Connor
*Attorney, Agent, or Firm*—Haseltine, Lake & Waters

[57] ABSTRACT

A bottom-dump vessel, whose longitudinal hull sections can be pivoted apart by jack means to provide an open bottom for discharge of cargo, has the adjoining edges of the keels of the hull sections interconnected by articulated rods which in substantial side-by-side position loch the hull sections in the closed position and in substantial end-to end position limit the angle of opening of the hull sections. The locking rods have means for positively driving them, thereby allowing for rapidly opening the vessel and transmitting appropriate braking forces to cope with mass forces. The arrangement makes for moderation in the size of jacks and other facilities required.

2 Claims, 9 Drawing Figures

BOTTOM-DUMP VESSEL

This invention relates to a bottom-dump vessel, and in particular to certain improvements in, or relating to, a wellknown kind of bottom-dump vessel having two pontoons forming the longitudinal walls and bottom walls of a cargo space, and being interconnected for hinging movement about a longitudinally extending effective hinging axis between a first terminal position in which the cargo space is closed at the bottom, and a second terminal position in which the cargo space is open at the bottom, and comprising jack means capable of moving the pontoons into said first terminal position, and locking means each comprising a pair of articulated locking rods forming a linkage with the two pontoons.

The two longitudinal pontoons or hull sections are commonly driven for hinging movement by means of jacks. The two longitudinal hull sections can be locked together in the closed position by locking means comprising, for example, pivoting hooks. The maximum closing force, i.e., the force required to keep the vessel in the closed position in fully loaded, unlocked condition, is a measure for the size of the jacks. According as the vessel is larger, the maximum closing forces will be greater, and hence the jacks and locking means should be of greater size. In order to limit the dimensions of the jacks, it has already been proposed to couple the jacks to locking means formed as pairs of locking rods. In this way smaller jacks can be used, because the closing force provided by the jacks is imparted through the pairs of locking rods.

When broken stone or the like is to be dumped at a given position, this should be completed within a very short time, because otherwise the vessel has drifted away too far owing to the currents in the water, as a result of which a portion of the cargo will not be dumped in the right place. Rapid discharge is considerably promoted when the two pontoons or longitudinal hull sections are rapidly moved apart to form a large opening at the bottom. This is in particular of importance in large barges. However, this involves large mass forces.

It is an object of the present invention to provide a novel construction for a bottom-dump vessel as described hereinbefore, so that it can be opened widely in a short period of time, while the jacks and other facilities used have relatively moderate dimensions.

According to the invention, there is provided a bottom-dump cargo vessel comprising two pontoons forming longitudinal walls and bottom walls of a cargo space and hinged together for movement about a longitudinal effective hinging axis between a first terminal position in which said cargo space is closed at the bottom and a second terminal position in which said cargo space is open at the bottom, and comprising jack means capable of moving said pontoons into said first terminal position, and locking means each comprising an articulated pair of locking rods forming a linkage with the two pontoons, characterized in that the rods of each articulated pair of locking rods are each pivoted to the keel of a different pontoon and in their two terminal positions corresponding to the two terminal positions of the pontoons extend in substantially the same direction.

Owing to the fact that the pairs of locking rods are mounted on the keels of the pontoons, a maximum lever length is obtained relative to the common hinge of the pontoons, as a result of which the maximum forces exercised on the pairs of locking rods are reduced, which forces can be welltaken up by the pontoons at the keels thereof without expensive reinforcing constructions being required. Also, the pairs of locking rods are utilized to the maximum extent to produce the largest possible angle of opening between the pontoons. In this arrangement, relatively small jacks can be used for breaking the opening movement of the pontoons and for closing the vessel.

In a preferred embodiment of the invention a jack is provided to act on the common pivot of the rods of a pair of locking rods.

The two terminal positions of the pairs of locking rods can be defined by stops, but alternatively be means of, for example, chains, connected to the pairs of locking rods and one pontoon. In a further elaboration of the inventive idea, each locking arrangement is provided with auxiliary means for exercising, in one or each of the two end positions, a force on the associated pair of locking rods tending to urge the same out of their end position. The auxiliary means can be so constructed that stops and the like are superfluous.

Further features of the invention will become apparent from the following description of three embodiments with reference to the accompanying diagrammatic drawings. In said drawings.

Figure 1:
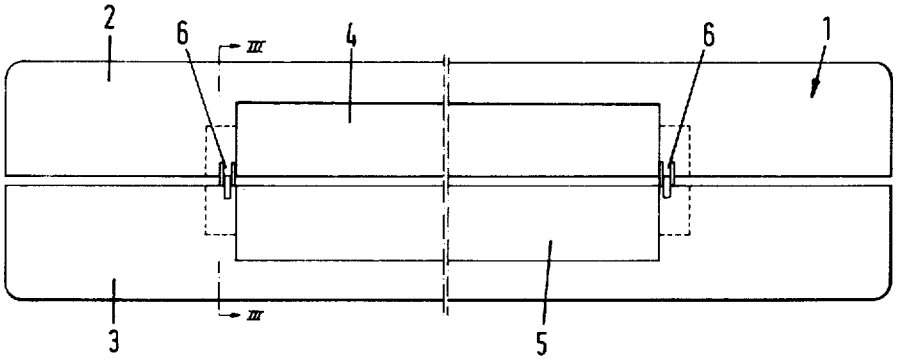
FIG. 1 shows a plan view of the fore-part and after end of one embodiment of a bottom-dump vessel.
Figure 2:
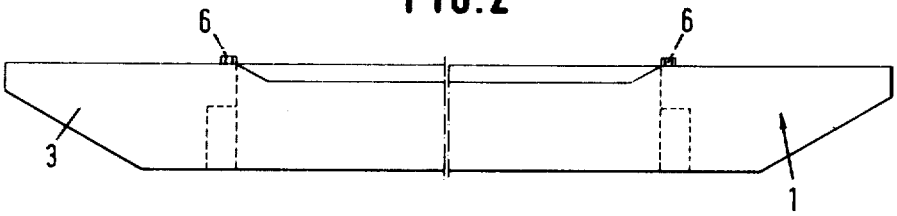
FIG. 2 shows a side-elevational view of the showing of FIG. 1.
Figure 5:
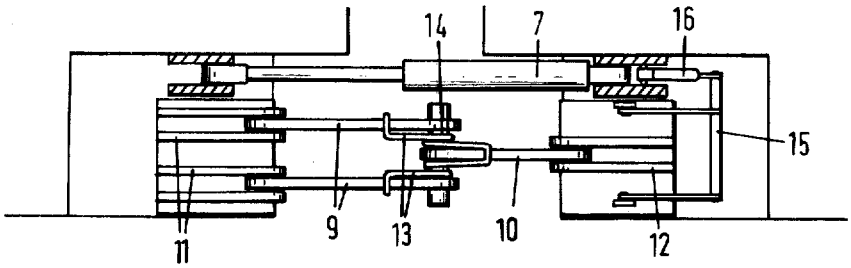
FIG. 5 is a cross-sectional view on the line V — V of FIG. 4.
Figure 3:
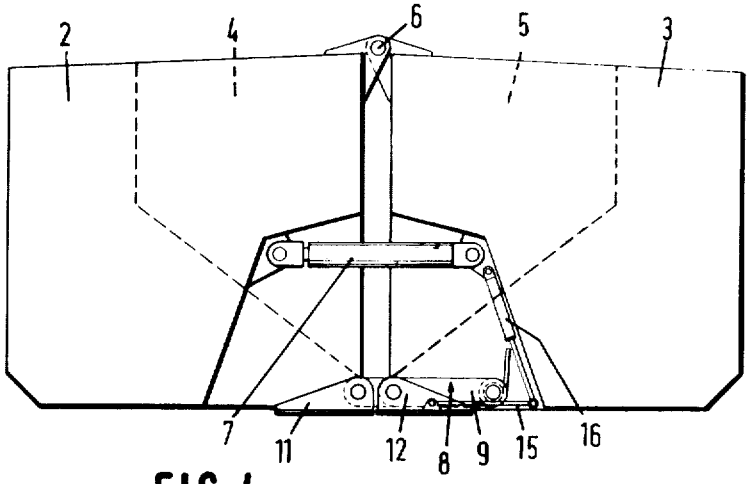
FIG. 3 is a cross-sectional view on the line III — III of FIG. 1.
Figure 4:
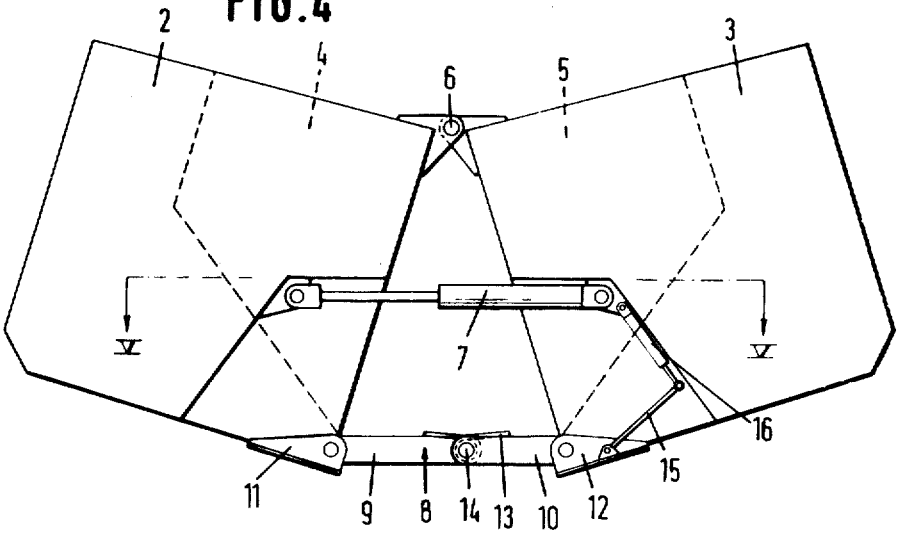
FIG. 4 is a cross-sectional view similar to FIG. 3, but showing the open condition of the vessel.

Referring to the drawings, a bottom-dump vessel 1 comprises two longitudinal, hinged-together hull sections or pontoons 2 and 3. Provided in the mid-ship is the cargo space of the vessel, which consists of two halves 4 and 5. The two hull sections are interconnected at the end of cargo space halves 4, 5 by means of hinges 6.

Vessel 1 is opened and closed by means of hydraulic jacks 7 located below hinges 6. In the closed position of the vessel the two longitudinal hull section 2, 3 are locked by means of locking devices provided on the keel below hinges 6. These locking devices also limit the extent of rotation of the two hull sections 2 and 3. The locking devices each comprise a pair 8 of locking rods 9 and 10, articulated together by means of pivots 14 on one end, and each pivoted at their other end through supports 11 and 12, respectively, to the keel of a different longitudinal hull section 2, 3, respectively, at a point in the vicinity of the adjoining edges of the latter. Lest the pairs of locking rods bend to the wrong side as the vessel 1 is closed, and in order to provide additional braking of the opening movement in the vicinity of the open terminal position, wound springs 13 are mounted around pivots 14 between rods 9, 10 of each pair of locking rods. Springs 13 as shown do not become operative until a certain angle of opening is reached, but they may alternatively be constructed to be operative in the closed position of the vessel to urge the pairs of locking rods 8 into the closed terminal position.

Pairs of locking rods 8 are opened by associated U-shaped members 15, the ends of whose legs are disposed on opposite sides of the associated pairs of locking rods 8, and pivoted to the keel of the longitudinal hull section 3 accommodating pivots 14 in the closed condition of the vessel. A jack 16 is pivoted to each U-shaped member 15 and to the longitudinal hull section 3. Jacks 16 are coupled together, so that all pairs of locking rods 8 are always simultaneously opened.

Vessel 1 is opened by energizing jacks 16, as a result of which pairs of locking rods 8 are raised by means of U-shaped members 15, and thus unlocked. Owing to the weight of vessel 1 and the cargo the vessel is opened. During the opening movement jacks 7 are energized to brake this movement. The energization can increase with the angle of opening. Meanwhile jack 16 is again de-energized. From a certain angle of opening, springs 13 become operative and increase the braking force. In this way the opening movement is sufficiently braked near the open terminal position of the vessel to considerably reduce the forces occurring as this terminal position is reached.

In order to keep the vessel in the open condition, jacks 7 can be de-energized.

For the closing movement of the vessel, jacks 7 are energized. Springs 13 urge pivots 14 of the pairs of locking rods upwardly, which provides additional closing force, and forces pairs of locking rods 8 to close in the right direction. When the two longitudinal hull sections 2, 3 have returned in the condition in which they are contiguous with one another, pairs of locking rods 8 fall shut, and the vessel is again in the closed locked condition.

Figure 6:
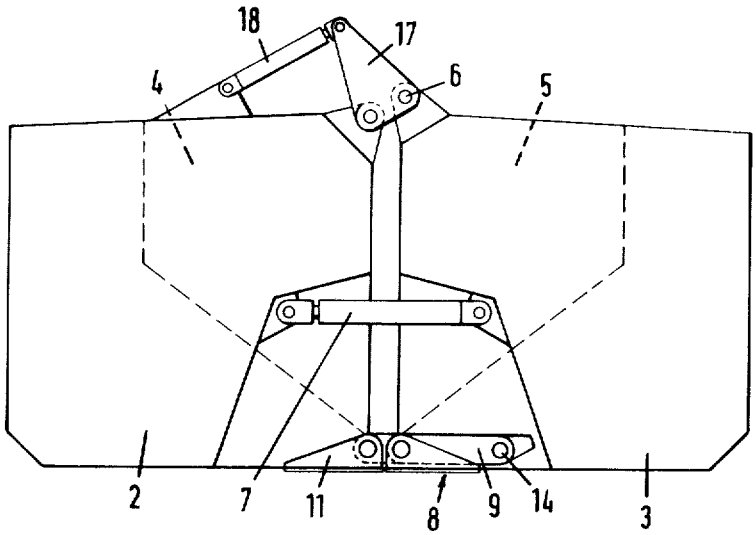
FIG. 6 is a cross-sectional view similar to FIG. 3 of a different embodiment.
Figure 7:
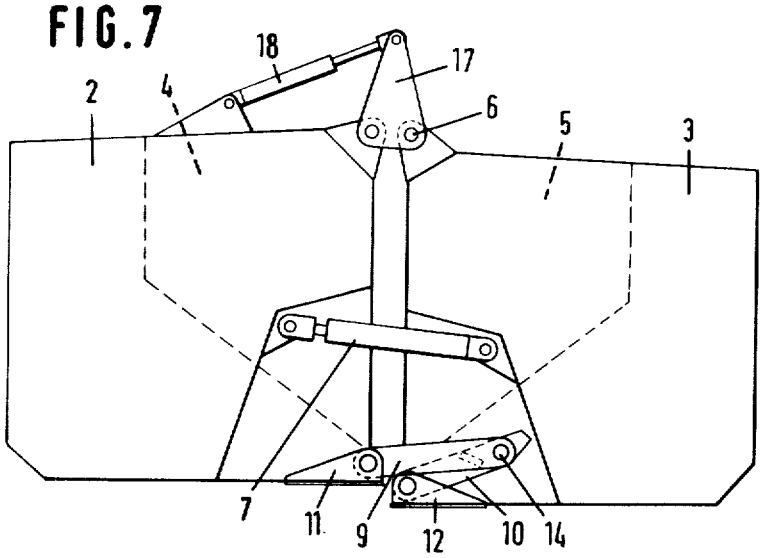
FIG. 7 is a cross-sectional view similar to FIG. 6 at the beginning of the opening movement.

The locking devices are not limited to the embodiment described. Thus, for example, instead of round springs 13, leaf spring constructions or torsion bars can be used for the same purpose. The auxiliary means active in the first terminal position can also be constructed in different ways. FIGS. 6 and 7 illustrate a different embodiment of the auxiliary means active in the first terminal position. As shown, there are no auxiliary means active in the second terminal position, but this is obviously possible. As compared with the previously described embodiment, similar parts are designated by the same reference numerals.

Pairs of locking rods 8 can also be opened by temporarily moving the two longitudinal hull sections 2, 3 relatively to each other in a substantially vertical sense. This is here effected by means of a lever 17, arranged above each pair of locking rods 8, and pivoted to the longitudinal hull section 2 which does not accommodate pivots 14 in the closed condition of the vessel. The other longitudinal hull section 3 is connected by pivots 6 to levers 17 instead of to longitudinal hull section 2. Levers 17 are operated by associated jacks 18, which are linked to these levers and to the same hull section 2 as are these levers.

When the ship is opened, this is effected by moving levers 17 out of their inoperative position by means of jacks 18, whereby the two longitudinal hull sections 2, 3 are moved relatively to each other in a substantially vertical sense. As a consequence pairs of locking rods 8 are unlocked, whereafter vessel 1 is opened through the weight of, inter alia, the cargo. After initiation of the opening movement, levers 17 are returned to their inoperative position by jacks 18. Here again, the opening movement is braked by jacks 7.

Figure 8:
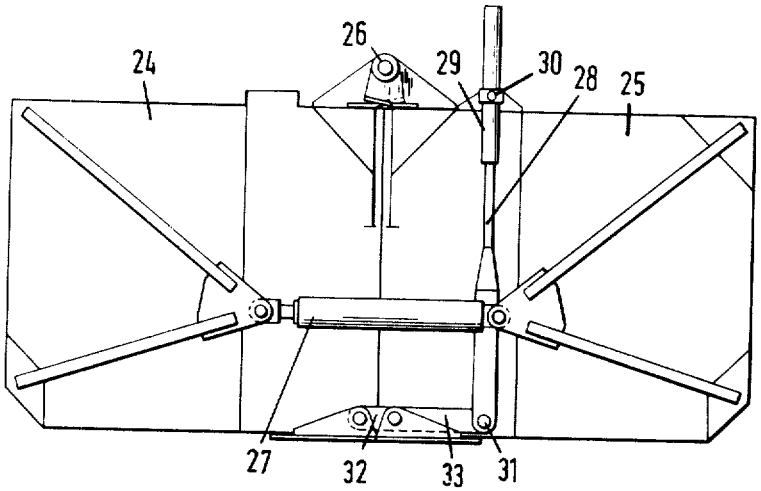
FIG. 8 is a cross-sectional view similar to FIG. 3 of still another embodiment.
Figure 9:
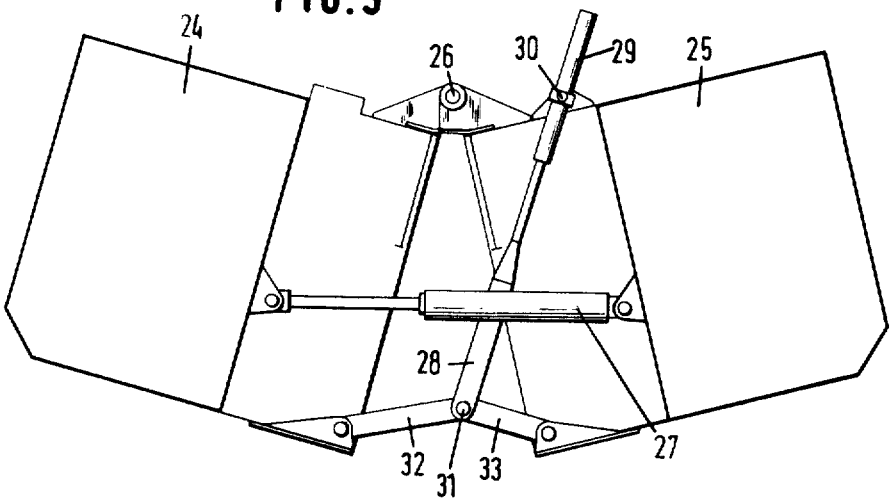
FIG. 9 is a cross-sectional view similar to FIG. 8, showing the vessel in a stage near the end of the opening movement.

In the embodiment illustrated in FIGS. 8 and 9, two pontoons 24, 25 are hinged together at 26, and can be tilted into the two terminal positions under the control of jacks 27 corresponding to jacks 7 of the embodiment described thereinbefore, and of substantially vertical jacks 28, 29, the cylinder 29 of which is pivoted approximately in its centre to pontoon 25 at 30, and piston rod 28 of which acts on the common pivot 31 of locking rods 32 and 33. The control by means of jacks 28, 29, effective in and near the two terminal positions, affords large actuating and braking forces.

I claim:

1. A bottom-dump cargo vessel comprising in combination, two pontoons forming longitudinal walls and bottom walls of a cargo space and hinged together for movement about a longitudinal effective hinging axis between a first terminal position in which said cargo space is closed at the bottom and a second terminal position in which said cargo space is open at the bottom; jack means for moving said pontoons into said first terminal position; and locking means each comprising an articulated pair of locking rods forming a linkage with the two pontoons, the rods of each articulated pair of locking rods being each pivoted to the keel of a different pontoon and in their two terminal positions corresponding to the two terminal positions of the pontoons extend in substantially the same direction; a jack acting on a common pivot of said rods of a pair of locking rods and extending in a substantially vertical direction, said jack acting on said common pivot extends upwardly beyond the pivot which it has in common with one of said pontoons.

2. A bottom-dump cargo vessel comprising in combination, two pontoons forming longitudinal walls and bottom walls of a cargo space and hinged together for movement about a longitudinal effective hinging axis between a first terminal position in which said cargo space is closed at the bottom and a second terminal position in which said cargo space is open at the bottom; jack means for moving said pontoons into said first terminal position; and locking means each comprising an articulated pair of locking rods forming a linkage with the two pontoons, the rods of each articulated pair of locking rods being each pivoted to the keel of a different pontoon and in their two terminal positions corresponding to the two terminal positions of the pontoons extend in substantially the same direction; said pair of rods being articulated together at a first end and have their other end respectively pivoted to the keel of one pontoon and the keel of the other pontoon, said rods turning substantially through 180° relative to each other during transition from an entirely open position of the vessel to an entirely closed position of the vessel, said rods being substantially in alignment in the two final positions, said rods having a common pivot controlled by a jack of said jack means connected to said pivot for hinging movement, said jack means being pivoted to one of said pontoons at a substantially elevated point, said jack means controlling the rate of opening and closing said pontoons.

* * * * *